US010222111B2

(12) United States Patent
Dirnberger et al.

(10) Patent No.: US 10,222,111 B2
(45) Date of Patent: Mar. 5, 2019

(54) ICE MAKER FOR FITTING INTO A DOOR OF A COOLING OR FREEZING DEVICE

(71) Applicant: emz-Hanauer GmbH & Co. KGaA, Nabburg (DE)

(72) Inventors: Albert Dirnberger, Neunburg v. W. (DE); Josef Bauriedl, Neunburg v. W. (DE); Christian Rittner, Weiden (DE)

(73) Assignee: emz-Hanauer GmbH & Co. KGaA, Nabburg (DE)

( * ) Notice: Subject to any disclaimer, the term of this patent is extended or adjusted under 35 U.S.C. 154(b) by 31 days.

(21) Appl. No.: 15/376,945

(22) Filed: Dec. 13, 2016

(65) Prior Publication Data

US 2017/0176080 A1 Jun. 22, 2017

(30) Foreign Application Priority Data

Dec. 18, 2015 (DE) ..... 10 2015 016 524

(51) Int. Cl.

| | |
|---|---|
| ***F25C 1/24*** | (2018.01) |
| ***F25C 1/243*** | (2018.01) |
| ***F25C 5/06*** | (2006.01) |
| *F25D 23/02* | (2006.01) |
| *F25D 23/04* | (2006.01) |

(52) U.S. Cl.

CPC ..... *F25C 1/243* (2013.01); *F25C 1/24* (2013.01); *F25C 5/06* (2013.01); *F25C 2305/022* (2013.01); *F25C 2500/02* (2013.01); *F25C 2500/06* (2013.01); *F25C 2500/08* (2013.01); *F25D 23/028* (2013.01); *F25D 23/04* (2013.01)

(58) Field of Classification Search

CPC ..... F25C 1/04; F25C 1/10; F25C 1/22; F25C 1/24; F25C 1/243

See application file for complete search history.

(56) References Cited

U.S. PATENT DOCUMENTS 1,740,919 A * 12/1929 Copeman ..... F25C 1/24 249/127
2,593,106 A 4/1952 Copeman
3,638,903 A 2/1972 Pietrzak et al.

(Continued)

FOREIGN PATENT DOCUMENTS

DE 2100717 7/1971
DE 102009046034 A1 5/2011

*Primary Examiner* — Orlando E Aviles
(74) *Attorney, Agent, or Firm* — Robert R. Deleault, Esq.; Mesmer & Deleault, PLLC

(57) ABSTRACT

An ice maker for fitting into a door of a cooling or freezing device includes an ice-making tray which is arranged to be rotatable about an axis of rotation, has a plurality of ice-piece-making cavities and a side wall arrangement which extends upwards beyond the ice-piece-making cavities and runs along the periphery of the tray. The ice maker further includes a drive unit for driving the ice-making tray in rotation about the axis of rotation. At least one slot is formed in the side wall arrangement and passes through the side wall arrangement over its entire wall thickness. Alternatively or in addition, at least a portion of the side wall arrangement is made of a different material than a bottom tray part on which the ice-piece-making cavities are formed. Both measures improve the twistability of the ice-making tray for breaking frozen ice pieces away from the tray.

20 Claims, 3 Drawing Sheets

(56) References Cited

U.S. PATENT DOCUMENTS

| | | | | |
|---|---|---|---|---|
| 8,534,087 | B2 * | 9/2013 | Lee | F25C 5/08 62/345 |
| 2012/0023996 | A1 * | 2/2012 | Herrera | F25C 1/04 62/340 |
| 2016/0258664 | A1 * | 9/2016 | Visin | F25C 1/243 |

* cited by examiner

ICE MAKER FOR FITTING INTO A DOOR OF A COOLING OR FREEZING DEVICE

BACKGROUND OF THE INVENTION

1. Field of the Invention

The present invention relates generally to an ice maker for fitting into a door of a cooling or freezing device.

2. Description of the Prior Art

Refrigerators for domestic use are nowadays increasingly supplied with built-in ice makers. The ice maker serves to produce cube-shaped ice pieces or ice pieces of other shapes, which can typically be dispensed via an ice-piece dispenser integrated into a door of the refrigerator. The ice pieces are produced in an ice-making tray, which has a plurality of cavities for producing one ice piece each.

While in some refrigerator models the ice maker is situated in the body of the refrigerator, in other refrigerator models the ice maker is arranged in the door of the cabinet. When the ice maker is arranged in the door there is the problem that, after the ice-making tray has been filled with fresh water, the water can spill out of the tray when the door is moved quickly and jerkily if the water has not yet solidified to form ice.

Protecting walls can be provided as spillage protection in front of, at the side of or/and behind the ice-making tray, which protecting walls ensure that water spilling out of the tray is guided back into the tray and does not drip down the door or even spill into the cooling chamber of the refrigerator. Although such protecting walls can provide satisfactory spillage protection, a problem which can arise in connection with rotatably mounted ice-making trays, which are rotated about an axis of rotation in order to eject the finished ice pieces, is that ice bridges form between the tray and the surrounding protecting walls. Such ice bridges can impede or even block rotation of the ice-making tray. In some circumstances, this can result in damage to a rotary drive motor for the ice-making tray.

SUMMARY OF THE INVENTION

It is an object of the invention to provide a way in which undesirable ice bridges, which can hinder or block rotation of an ice-making tray, can be avoided in the case of an ice maker intended for fitting into a door of a cooling or freezing device. At the same time, good spillage protection is to be possible.

In order to achieve this object, the invention starts from an ice maker for fitting into a door of a cooling or freezing device, comprising: an ice-making tray which is arranged to be rotatable about an axis of rotation and has a plurality of ice-piece-making cavities and a side wall arrangement which extends beyond the ice-piece-making cavities at the top and runs along the periphery of the tray, and a drive unit for driving the ice-making tray in rotation about the axis of rotation. According to the invention, a wall section of the side wall arrangement extending in the direction of the axis of rotation is formed with at least one slot which passes through the wall section over its entire wall thickness.

The invention is based on the idea of making the side wall arrangement of the ice-making tray sufficiently high—relative to an upper cavity edge of the ice-piece-making cavities—so that the side wall arrangement itself is able to provide adequate spillage protection and protecting walls outside the ice-making tray are consequently not necessary. The increased height of the side wall arrangement as compared with conventional ice-making trays can, however, lead to increased torsional stiffness of the tray about the axis of rotation. In the case of ice makers which work according to the "twisted tray" principle, once the water introduced into the ice-piece-making cavities has frozen, the ice-making tray is rotated as a whole about the axis of rotation and is additionally twisted in itself about the axis of rotation. This twisting of the ice-making tray is intended to cause the ice pieces which have been produced to break away from the ice-making tray. The provision of one or more slots in the side wall arrangement can counteract the mentioned increase in the torsional stiffness of the ice-making tray as a result of the increased height of the side wall arrangement and consequently ensure that, despite the increased height of the side wall arrangement, the ice-making tray can be twisted to a sufficient degree to cause the ice pieces to break away from the tray in the desired manner.

In some embodiments, the slot extends as far as an upper edge of the side wall arrangement. The slot can thereby end at a distance above the ice-piece-making cavities. The slot can extend, starting from the upper edge of the side wall arrangement, over a height—measured in a direction perpendicular to the tray plane of the ice-making tray—of at least 1 cm or at least 1.5 cm or at least 2 cm. Alternatively or in addition, the slot can end at a distance—measured in a direction perpendicular to the tray plane of the ice-making tray—of not more than 2 cm or not more than 1.5 cm or not more than 1 cm from an upper cavity edge of the ice-piece-making cavities.

In order to minimise a break in the protecting action of the side wall arrangement by the at least one slot and to prevent the escape of water through the at least one slot as far as possible, it is provided in some embodiments that opposite slot delimiting surfaces of the slot touch one another at least over a portion of the slot length. Where the slot delimiting surfaces touch one another there is no free space between the slot delimiting surfaces, so that there is also no gap there for the passage of water. However, even when opposite slot delimiting surfaces of the slot are at a mutual distance from one another over the entire slot length of not more than 1 mm or 0.5 mm or 0.3 mm or 0.1 mm, it is possible largely to prevent water from passing through the slot in an undesired manner. Typically, the water in the ice-making tray sloshes against the side wall arrangement for only a comparatively short time when the refrigerator door is closed or opened quickly. If the slot is sufficiently narrow, this short time is not sufficient to allow a substantial amount of water to pass through the slot even if there is a clear space inside the slot.

In some embodiments, the ice-making tray has the shape of a rectangle with longer rectangle sides running along the axis of rotation and shorter rectangle sides running transversely to the axis of rotation, the side wall arrangement comprising two mutually opposite long-side wall sections each extending along one of the longer rectangle sides and two mutually opposite short-side wall sections each extending along one of the shorter rectangle sides. At least one slot is formed in each of the two long-side wall sections. In some embodiments, a slot is formed in at least one of the long-side wall sections approximately centrally along the longer rectangle sides. A plurality of slots spaced apart one behind the other in the direction of the axis of rotation can be formed in at least one of the long-side wall sections. In addition, the side wall arrangement can be formed with a further slot in at least one, preferably in each, corner region of the ice-making tray.

The slot extends in some embodiments along a plane orthogonal to the axis of rotation or runs obliquely to that plane at least over a portion of its slot length.

Alternatively or in addition to the provision of one or more slots in the side wall arrangement, the object of achieving high spillage protection by means of the side wall arrangement while at the same time ensuring that the ice-making tray is twistable can be achieved by forming different regions of the ice-making tray of different materials, a first tray region formed of a first material including cavity walls of the ice-piece-making cavities and a second tray region formed of a second material including a wall section of the side wall arrangement which includes at least a portion of an upper edge of the side wall arrangement. For example, the second tray region has rubber elasticity or/and the second material is deformable by a smaller force than is the first material. In some embodiments, the first material comprises polyethylene or polypropylene, while the second material comprises a rubber material (for example of natural or synthetic rubber) or a silicone material or a thermoplastic elastomer.

In some embodiments, the ice-making tray is formed by a single component, that is to say the first tray region and the second tray region are situated on that single component. In this case, the ice-making tray can be a multi-component injection-moulded part. Injection moulding processes, in which different materials are processed in a single component, are conventionally available. In other embodiments, the first tray region and the second tray region can belong to separate components which can be fitted together or otherwise connected, optionally releasably connected, to form the ice-making tray. For example, the second tray region can form a frame part which can be fitted to a bottom tray part which is formed by the first tray region and includes the ice-piece-making cavities.

In some embodiments, the second tray region encircles the ice-making tray, a boundary line between the first and the second tray region lying above an upper cavity edge of the ice-piece-making cavities. For example, the boundary line lies not less than 0.5 cm or not less than 1 cm above the upper cavity edge.

In some embodiments, the second tray region extends over a height—measured in a direction perpendicular to the tray plane of the ice-making tray—which corresponds to at least 0.5 times or 0.7 times or 0.8 times or 0.9 times the height measured from a cavity bottom to an upper cavity edge of the ice-piece-making cavities.

In some embodiments, the ice-making tray has the shape of a rectangle with longer rectangle sides running along the axis of rotation and shorter rectangle sides running transversely to the axis of rotation. The side wall arrangement thereby comprises two mutually opposite long-side wall sections each extending along one of the longer rectangle sides and two mutually opposite short-side wall sections each extending along one of the shorter rectangle sides. The two long-side wall sections—when viewed in a section orthogonal to the axis of rotation—can be inclined towards one another. Alternatively or in addition, the two long-side wall sections—again when viewed in a section orthogonal to the axis of rotation—can be bent towards one another in a concave manner.

Good spillage protection can be achieved, for example, if the side wall arrangement at least of portions of the tray periphery running along the axis of rotation has a height—measured in a direction perpendicular to the tray plane of the ice-making tray—of at least 2 cm or 2.5 cm or 3 cm or 3.5 cm above an upper cavity edge of the ice-piece-making cavities.

The invention is described further hereinbelow with reference to the accompanying drawings.

DETAILED DESCRIPTION OF THE PREFERRED EMBODIMENT

Figure 1:
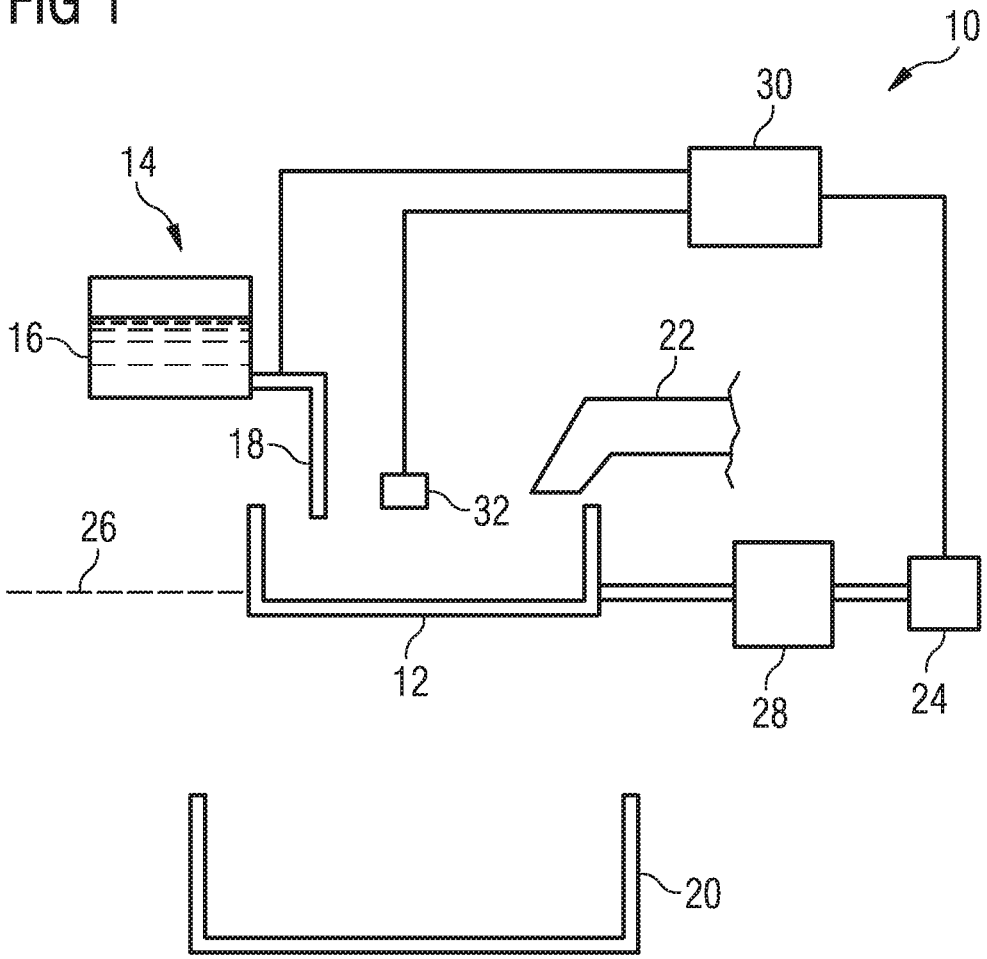
FIG. 1 shows, in schematic form, components of an ice maker for a cooling or freezing device for domestic use.

Reference will first be made to FIG. 1. The ice maker shown therein is generally designated 10. It comprises an ice-making tray 12 in which ice cubes or ice pieces of another shape are produced. For this purpose, the ice-making tray 12 has a plurality of ice piece production cavities, each of which serves to produce a single ice piece. The ice piece production cavities are not shown in the schematic general view of FIG. 1, but they can be seen in the further figures.

By means of a water supply device 14, the ice-making tray 12, more specifically the ice piece production cavities, can be filled with water, which is then to be frozen to form ice pieces. In the example shown, the water supply device 14 comprises a water storage container 16 as well as an inlet 18 via which water from the storage container 16 can be introduced in a quantity-controlled manner into the ice-making tray 12.

Beneath the ice-making tray 12 there is a receiving container 20 in which the ice pieces which have been produced and ejected from the ice-making tray 12 are received and collected. The receiving container 20 can be coupled with an ice-piece dispenser (not shown), via which the ice pieces stored in the receiving container 20 can be dispensed in a metered manner.

From a cold air source (not shown), cold air is guided via a cold air line 22 into the region of the ice-making tray 12, where it is ejected. The ejected cold air flows over the top or/and bottom of the ice-making tray 12 and thereby removes heat energy from the water which has been introduced into the ice-making tray 12, so that the water is made to freeze.

The ice-making tray 12 can be driven by means of a drive unit 24, for example an electric motor drive unit, about an axis of rotation shown at 26 by means of a broken line. In the example shown in FIG. 1 there is a reduction gear unit 28 in the force transmission path between the drive unit 24 and the ice-making tray 12. The ice-making tray 12 must be rotatable in order that a batch of ice pieces can be ejected from the ice-making tray 12 when production is complete. The drive unit 24 is controlled by a control unit 30, for example a microprocessor-based control unit. Under the control of the control unit 30, the drive unit 24 is able to rotate the ice-making tray 12 from an ice production position, in which it is located with its tray plane horizontal, through at least 90° and optionally even further about the axis of rotation 26 into an ice ejection position, in which the ice pieces are able to fall from the ice-making tray 12 into the receiving container 20. From a particular angle of rotation of the ice-making tray 12, the ice-making tray 12, if the drive unit 24 continues to operate, begins to twist about the axis of rotation 26, as a result of which the ice pieces produced therein break away from the ice-making tray 12.

This technology, known as twist tray in the art, is known per se; further explanation is therefore not necessary at this point.

By means of a suitable sensor system, which is indicated schematically in FIG. 1 by a sensor 32, the state of freezing of the water in the ice-making tray 12 can be detected by means of sensors. For example, the sensor system can comprise one or more infra-red sensors or/and thermistors. The sensor system supplies its sensor signal, or sensor signals, to the control unit 30 which, in dependence on the detected state of freezing, controls the cold air supply via the cold air line 22 or/and operation of the drive unit 24. The control unit 30 is additionally responsible for controlling the supply of water from the water supply device 16 into the ice-making tray 12.

In the use state, the ice-making tray 12 and at least some of the further components of the ice maker 10 are fitted into a door of a refrigerator or freezer (not shown). In the case of jerking movements of the cabinet door, as can scarcely be avoided when the door is opened and closed, sloshing movements of the water in the ice-making tray 12 can occur if a sufficiently strong ice crust has not yet formed. By means of a special form of the ice-making tray 12 it is ensured that no water or—if any—only insignificant amounts of water spill out of the ice-making tray 12. In this connection, FIGS. 2 to 5 show two embodiments which are described in detail hereinbelow. The same reference numerals are used throughout the description of these two embodiments for components which are the same or which have the same effect, but the reference numerals in the two embodiments are distinguished from one another by the addition of a lower case letter.

Figure 2:
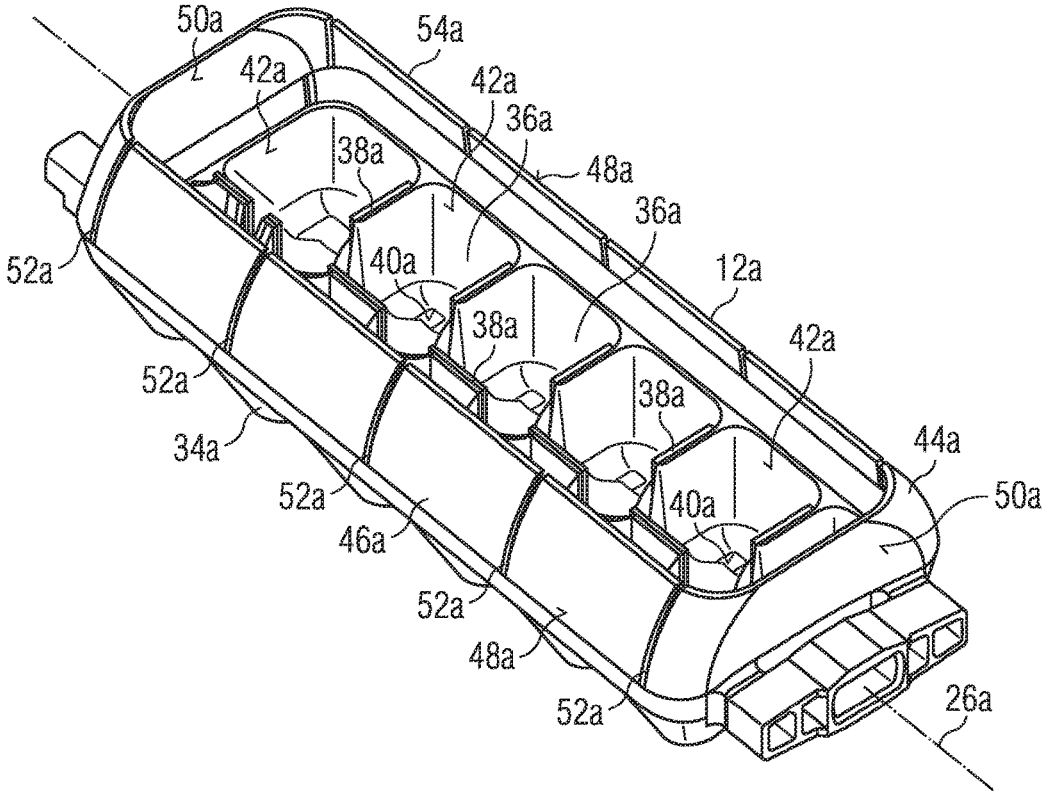
FIGS. 2 and 3 are perspective views of an ice-making tray for the ice maker of FIG. 1 according to a first embodiment.
Figure 3:
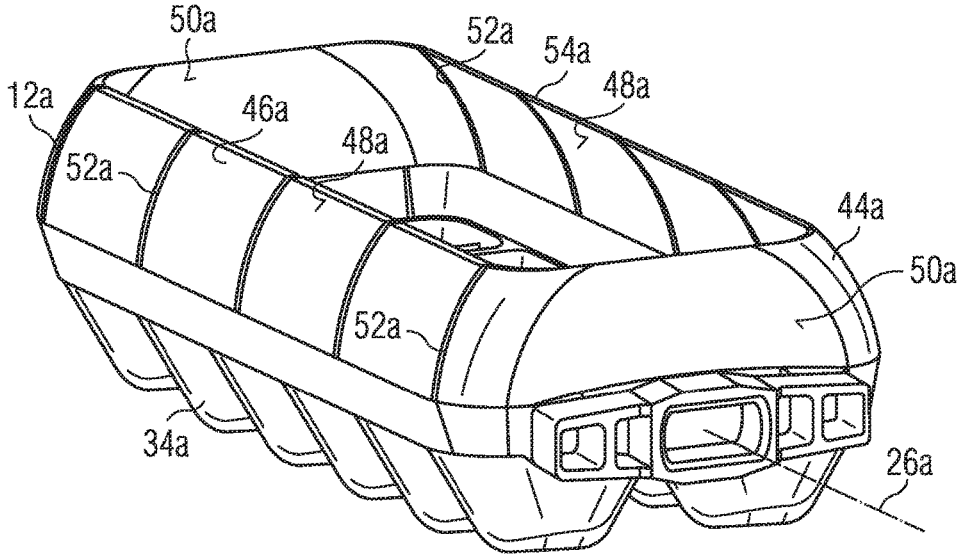
Figure 4:
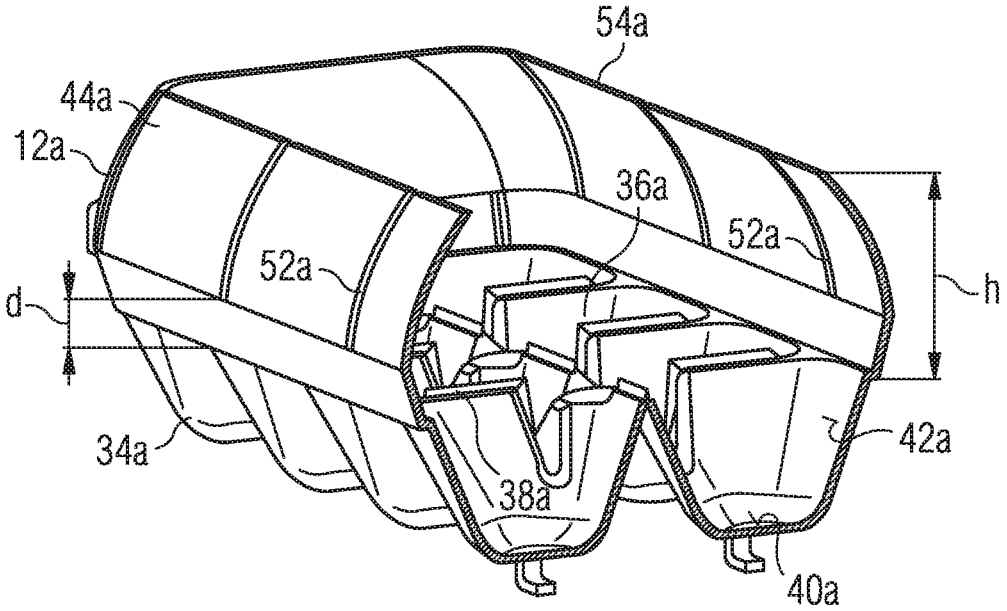
FIG. 4 is a perspective sectional view of the ice-making tray of FIGS. 2 and 3.

The first embodiment is shown in FIGS. 2 to 4. The ice-making tray, denoted 12*a*, shown therein has a bottom tray part 34*a* in which a plurality of ice piece production cavities 36*a* are formed. The ice piece production cavities 36*a* are distributed over two parallel rows of cavities which extend in the direction of the axis of rotation 26*a* of the ice-making tray 12*a*, so that the ice-making tray 12*a* overall has an approximately rectangular shape with longer rectangle sides running along the axis of rotation 26*a* and shorter rectangle sides running transversely to the axis of rotation 26*a*. Adjacent pairs of ice piece production cavities 36*a* are separated from one another by a separating web 38*a*. The separating webs 38*a* define an upper cavity edge of the ice piece production cavities 36*a*. The bottom tray part 34*a* additionally forms cavity walls which define a cavity bottom 40*a* and a cavity shell 42*a* for each of the ice piece production cavities 36*a*.

The ice-making tray 12*a* additionally comprises a top tray part 44*a* which forms a side wall arrangement 46*a* which extends upwards starting from the upper cavity edge and runs along the rectangular tray periphery. The side wall arrangement 46*a* comprises two long-side side wall sections 48*a* which extend along the axis of rotation 26*a* (that is to say along the longer rectangle sides of the ice-making tray 12*a*) and face one another on either side of the double row of ice piece production cavities 36*a* and which protect against the spillage of water from the ice-making tray 12*a* transversely to the axis of rotation 26*a*. The side wall arrangement 46*a* further comprises two short-side side wall sections 50*a* which extend perpendicularly to the axis of rotation 26*a* (that is to say along the shorter rectangle sides) and face one another at the ends of the double row of ice piece production cavities 36*a* and which protect against the spillage of water from the ice-making tray 12*a* in the direction along the axis of rotation 26*a*. Overall, the long-side side wall sections 48*a* and the sort-side side wall sections 50*a* form a protecting wall against the spillage of water which is closed all round the periphery of the tray.

In the embodiment of FIGS. 2 to 4, a plurality of slots 52*a* are formed in each of the long-side side wall sections 48*a*. These slots 52*a* serve to reduce the torsional stiffness of the top tray part 44*a* about an axis of twist parallel to the axis of rotation 26*a* and extend as far as the upper edge, denoted 54*a*, of the side wall arrangement 46*a*. In the example shown, the slots 52*a* are therefore slots which are open on one side (that is to say open at the upper edge 54*a* of the side wall arrangement 46*a*). The slots 52*a* pass through the entire wall thickness of the long-side side wall section 48*a* in question and extend in a downward direction (that is to say in the direction towards the bottom tray part 34*a*) to a point which lies at a distance above the upper cavity edge of the ice piece production cavities 36*a*. This distance is represented graphically in FIG. 4 by the parameter d. In actual embodiments, the distance d can be between 1 cm and 2 cm, for example.

In the example shown, a total of five slots 52*a* are formed in each of the long-side side wall sections 48*a*. These are distributed at substantially equal intervals along the long-side side wall section 48*a* in question and all have an identical slot length (measured in the direction from top to bottom). It will be appreciated that in different embodiments at least some of the slots 52*a* formed in the long-side side wall sections 48*a* can have different slot lengths or/and can have different distances from one another. It will likewise be appreciated that, in some embodiments, one or more slots can also be formed in each of the short-side side wall sections 50*a*, if required. Of the total of five slots 52*a* formed in each of the long-side side wall sections 48*a* in the example shown, one is located approximately in the middle of the side wall section 48*a* in question (seen in the direction of the axis of rotation 26*a*) and two others are located close to the corner regions of the ice-making tray 12*a* adjacent to the side wall section 48*a* in question or in those corner regions. It will be appreciated that the total number of slots 52*a* per side wall section 48*a* can be greater than or less than 5. For example, it may be sufficient under certain circumstances to provide a single slot 52*a* in each of the long-side side wall sections 48*a*.

In order to avoid as far as possible the undesired passage of water through the slots 52*a*, the slots 52*a* are sufficiently narrow that, at least in the untwisted state of the ice-making tray 12*a*, their mutually opposite slot delimiting surfaces either touch one another or are at a mutual distance from one another of not more than a few tenths of a millimeter, for example not more than 0.3 mm. With such a small slot width of the slots 52*a*, water is able to escape through the slots 52*a* at most in an insignificant amount in the short period of time in which liquid water in the ice-making tray 12*a* sloshes against the long-side side wall sections 48*a* when the door of the refrigerator or freezer is opened or closed abruptly.

As explained, the slots 52*a* formed in the long-side side wall sections 48*a* reduce the torsional stiffness of the top tray part 44*a* in comparison with a configuration without slots. This allows the side wall arrangement 46*a* to be made higher than in a version without the slots 52*a*, without increasing the torsional stiffness of the ice-making tray 12*a* as a whole. Better protection against the spillage of water from the ice-making tray 12*a* is achieved by the increased height of the side wall arrangement 46*a*. The height measured from the upper cavity edge of the ice piece production cavities 36*a* to the upper edge 54*a* of the side wall arrangement 46*a* is represented graphically in FIG. 4 by the parameter h. For example, the height h can have a value between 2 cm and 3.5 cm. In the example shown, the side wall arrangement 46*a* has substantially the same height h along the entire periphery of the tray. In other embodiments, it is conceivable that the height h of the side wall arrangement 46*a* is not the same everywhere but, for example, is slightly lower in the region of the short-side side wall sections 50*a* than in the region of the long-side side wall sections 48*a*.

The long-side side wall sections 48*a* are inclined towards one another in the direction towards the upper edge 54*a* of the side wall arrangement 46*a*, so that they are at a smaller distance from one another in the region of the upper edge 54*a* than in their foot region (which is the region immediately above the upper cavity edge of the ice piece production cavities 36*a*). The long-side side wall sections 48*a*, as can be seen particularly well in FIG. 4, are thereby bent towards one another in a concave manner, that is to say they extend in the form of an arc between the foot region and the upper edge 54*a*. This bent form of the long-side side wall sections 48*a* improves the protective action against the spillage of water.

In the example shown, the short-side side wall sections 50*a* are not bent and are not inclined relative to a plane orthogonal to the axis of rotation 26*a*. In other embodiments, however, it is of course conceivable that the short-side side wall sections 50*a* are inclined relative to one another in a comparable manner and are optionally bent.

In the example shown in FIGS. 2 to 4, the slots 52*a* run parallel to a plane orthogonal to the axis of rotation 26*a* over their entire slot length. In other words, the slots 52*a* have a straight course, when the ice-making tray 12*a* is viewed from the side perpendicularly to the axis of rotation 26*a*. It is of course possible that at least some of the slots 52*a* run obliquely to a plane orthogonal to the axis of rotation 26*a* at least over a portion of their slot length. For example, at least some of the slots 52*a* can run in a straight line obliquely to such a plane, or they can have a bent course.

In the embodiment of FIGS. 2 to 4, the top tray part 44*a* can be made of the same material as the bottom tray part 34*a*, so that both tray parts 44*a*, 34*a* can be manufactured together as one component, for example from polyethylene or polypropylene. Without the slots 52*a*, however, the top tray part 44*a*—with the same wall height h of the side wall arrangement 46*a*—could have excessively high torsional stiffness if the top tray part 44*a* is manufactured from the same material as the bottom tray part 34*a*. For a form in which slots in the top tray part are not necessary but sufficient twistability of the ice-making tray as a whole can nevertheless be ensured, reference will now be made to the embodiment according to FIG. 5. Unless indicated otherwise hereinbelow, reference is made to the comments above for the description of the individual constituents of the ice-making tray 12*b* shown in FIG. 5.

Figure 5:
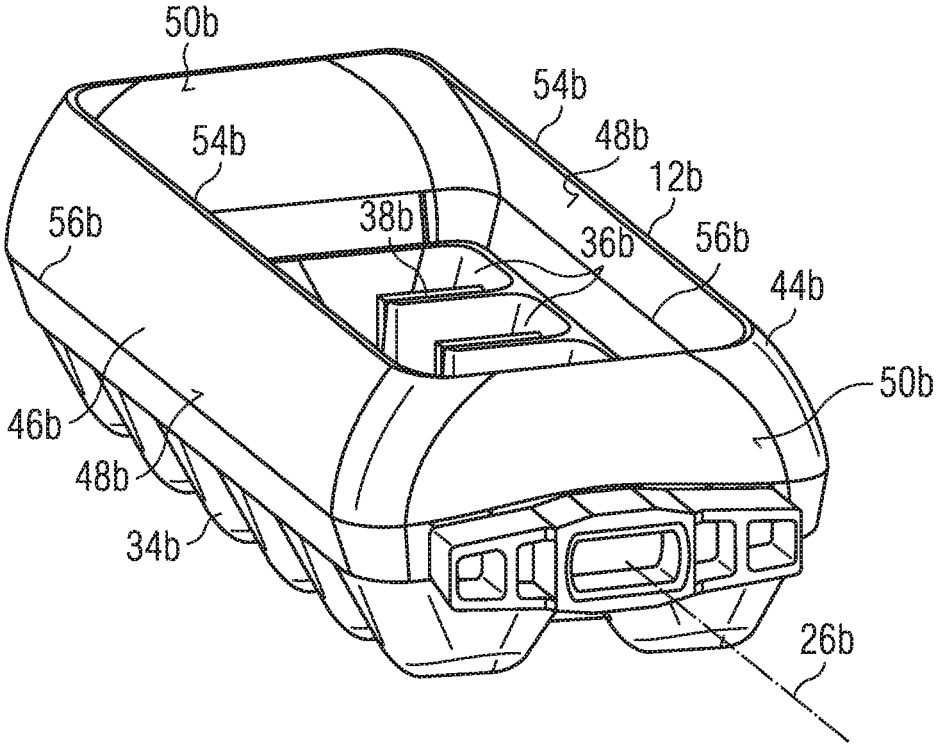
FIG. 5 is a perspective view of an ice-making tray for the ice maker of FIG. 1 according to a further embodiment.

In the ice-making tray 12*b* of FIG. 5, the bottom tray part 34*b* and a region of the top tray part 44*b* situated below the boundary line 56*b* are manufactured from a first material, for example polyethylene or polypropylene, while a region of the top tray part 44*b* situated above the boundary line 56*b* is formed of a second material which is different from the first material and ensures that the top tray part 44*b* is more readily twistable about an axis of twist parallel to the axis of rotation 26*b* than would be the case if the region of the top tray part 44*b* situated above the boundary line 56*b* were also manufactured, with otherwise identical geometry, from the same material as the bottom tray part 34*b*. In some embodiments, the second material has rubber-elastic properties; it can be formed, for example, by a silicone material, a thermoplastic elastomer or a material based on a natural or synthetic rubber. As a result of this choice of material for the region of the top tray part 44*b* situated above the boundary line 56*b*, good twistability of the ice-making tray 12*b* overall is ensured despite the comparatively great height of the side wall arrangement 46*b*. In the example shown, the boundary line 56*b* encircles the ice-making tray 12*b* and is situated slightly above the upper cavity edge of the ice piece production cavities 36*b*. For example, the boundary line 56*b* runs approximately 1 cm above the upper cavity edge of the ice piece production cavities 36*b*. It will be appreciated that in other embodiments the top tray part 44*b* can be manufactured wholly from the second material. In this case, the boundary line 56*b* runs at the transition between the bottom tray part 34*b* and the top tray part 44*b*. Even if, as in the example shown, the boundary line 56*b* runs inside the top tray part 44*b* and accordingly divides the top tray part 44*b* into a region below the boundary line 56*b* consisting of the first material and a region above the boundary line 56*b* consisting of the second material, the height of the region located above the boundary line 56*b*, measured in a direction perpendicular to the tray plane of the ice-making tray 12*b*, is preferably substantially larger than, for example at least twice or three times as large as, the height of the region of the top tray part 44*b* located beneath the boundary line 56*b*.

In order to achieve sufficiently easy twistability of the ice-making tray 12*b*, it can be sufficient for the second material to be situated only in the region of the long-side side wall sections 48*b* of the side wall arrangement 46*b*. The short-side side wall sections 50*b* can in some embodiments be manufactured from the first material which is also used for the bottom tray part 34*b*.

The ice-making tray 12*b* can be produced as a one-part component, for example in a two-component injection moulding process.

It will be appreciated that in the case of the ice-making tray 12*b* too, one or more slots similar to the slots 52*a* of the first embodiment can be formed in the side wall arrangement 46*b*. The measure of providing one or more slots for the purpose of improved twistability of the ice-making tray can accordingly be combined with the measure of locally different materials, as is applied in the embodiment according to FIG. 5.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. An ice maker for fitting into a door of a cooling or freezing device, comprising:

an ice-making tray which is arranged to be rotatable about an axis of rotation, has a plurality of ice piece production cavities wherein adjacent pairs of the ice piece production cavities are separated from one another by a separating web which defines an upper cavity edge and a side wall arrangement directly connected to and which extends beyond the ice piece production cavities from the upper cavity edge and runs along the periphery of the tray wherein the side wall arrangement includes a wall section extending in a direction of the axis of rotation and being formed with at least one slot that extends upwards in a direction away from the upper cavity edge beginning from a point which lies at a distance above the upper cavity edge of the plurality of the ice piece production cavities toward an upper edge of the side wall arrangement; and a drive unit for driving the ice-making tray in rotation about the axis of rotation.

2. The ice maker according to claim 1, wherein the at least one slot extends as far as the upper edge of the side wall arrangement.

3. The ice maker according to claim 2, wherein the at least one slot passes through the entire wall thickness of the wall section.

4. The ice maker according to claim 2, wherein the at least one slot extends, starting from the upper edge of the side wall arrangement ends at a distance, measured in a direction perpendicular to the upper cavity edge of the plurality of ice production cavities, wherein the distance is not more than 2 cm from the upper cavity edge of the ice piece production cavities.

5. The ice maker according to claim 1, wherein opposite slot delimiting surfaces of the at least one slot touch one another at least over a portion of a slot length.

6. The ice maker according to claim 1, wherein opposite slot delimiting surfaces of the at least one slot are at a mutual distance from one another over an entire slot length wherein the mutual distance is not more than 1 mm.

7. The ice maker according to claim 1, wherein the ice-making tray has the shape of a rectangle with longer rectangle sides running along the axis of rotation and shorter rectangle sides running transversely to the axis of rotation, the side wall arrangement comprising two mutually opposite long side wall sections each extending along one of the longer rectangle sides and two mutually opposite short-side wall sections each extending along one of the shorter rectangle sides, each of the long-side wall sections having a slot of the at least one slot.

8. The ice maker according to claim 7, wherein at least one of the long-side wall section has the slot of the at least one slot centrally located along one of the longer rectangle sides.

9. The ice maker according to claim 7, wherein at least one of the long-side wall sections has a plurality of slots of the at least one slot spaced apart from one another in the direction of the axis of rotation.

10. The ice maker according to claim 7, wherein the side wall arrangement is formed with a further slot in at least one corner region of the side wall arrangement of the ice-making tray.

11. The ice maker according to claim 1, wherein the at least one slot extends along a plane orthogonal to the axis of rotation or runs obliquely to that plane at least over a portion of a slot length.

12. The ice maker according to claim 1, wherein different regions of the ice-making tray are formed of different materials, a first tray region formed of a first material including cavity walls of the plurality of ice piece production cavities and a second tray region formed of a second material including a wall section of the side wall arrangement which includes at least a portion of an upper edge of the side wall arrangement.

13. The ice maker according to claim 12, wherein the second material of the second tray region has rubber elasticity or is deformable by a smaller force than is the first material or has rubber elasticity and is deformable by a smaller force than is the first material.

14. The ice maker according to claim 12, wherein the first material comprises polyethylene or polypropylene and the second material comprises a rubber material or a silicone material or a thermoplastic elastomer.

15. The ice maker according to claim 12, wherein the ice-making tray is a multi-component injection-moulded part.

16. The ice maker according to claim 12, wherein the second tray region encircles the ice-making tray, and a boundary line between the first and the second tray region lies above the upper cavity edge of the ice piece production cavities, a location of the boundary line being not less than 0.5 cm above the upper cavity edge.

17. The ice maker according to claim 12, wherein the second tray region extends over a height, measured in a direction perpendicular to the upper cavity edge of the plurality of ice production cavities, which height is at least 0.5 times the height measured from a cavity bottom to the upper cavity edge of the ice piece production cavities.

18. The ice maker according to claim 1, wherein the ice-making tray has the shape of a rectangle with longer rectangle sides running along the axis of rotation and shorter rectangle sides running transversely to the axis of rotation, the side wall arrangement comprising two mutually opposite long-side wall sections each extending along one of the longer rectangle sides and two mutually opposite short-side wall sections each extending along one of the short rectangle sides, the two long-side wall sections, when viewed in a section orthogonal to the axis of rotation, being inclined towards one another.

19. The ice maker according to claim 1, wherein the ice-making tray has the shape of a rectangle with longer rectangle sides running along the axis of rotation and shorter rectangle sides running transversely to the axis of rotation, the side wall arrangement comprising two mutually opposite long-side wall sections each extending along one of the longer rectangle sides and two mutually opposite short-side wall sections each extending along one of the shorter rectangle sides, the two long-side wall sections, when viewed in a section orthogonal to the axis of rotation, being bent towards one another in a concave manner.

20. The ice maker according to claim 1, wherein at least portions of the side wall arrangement running along the axis of rotation has a height, measured in a direction perpendicular to the upper cavity edge of the plurality of ice piece production cavities, of at least 2 cm above the upper cavity edge of the ice piece production cavities.

* * * * *